United States Patent [19]

Zander

[11] 4,028,920

[45] June 14, 1977

[54] APPARATUS FOR HIGH SPEED WINDING OF COILS

[75] Inventor: Georg Zander, Stolberg, Germany

[73] Assignee: U.S. Philips Corporation, New York, N.Y.

[22] Filed: Dec. 8, 1975

[21] Appl. No.: 638,509

[30] Foreign Application Priority Data

Dec. 12, 1974 Germany ..... 2458721

[52] U.S. Cl. ..... 72/66; 72/142; 140/71.5

[51] Int. Cl.[2] ..... B21D 11/06; B21F 3/04; B21F 45/00

[58] Field of Search ..... 72/142, 143, 144, 66; 140/71 R, 71 C, 71.5

[56] References Cited

UNITED STATES PATENTS

| | | | |
|---|---|---|---|
| 2,649,130 | 8/1953 | Border | 72/144 X |
| 3,031,006 | 4/1962 | Fokkinga | 72/144 X |
| 3,433,041 | 3/1969 | Cavagnero et al. | 72/143 X |
| 3,468,148 | 9/1969 | Tsurumoto | 72/142 X |

FOREIGN PATENTS OR APPLICATIONS

| | | | |
|---|---|---|---|
| 1,143,930 | 2/1963 | Germany | |
| 2,006,877 | 8/1971 | Germany | 72/142 |

*Primary Examiner*—Francis S. Husar
*Assistant Examiner*—John S. Brown
*Attorney, Agent, or Firm*—Frank R. Trifari; David R. Treacy

[57] ABSTRACT

A device for the manufacture of coils in which the winding wire is guided to a winding head via a winding drum having an eccentric wire guiding bore. The winding drum and the winding head rotate in opposite directions so as to achieve an effective winding speed greater than either rotational speed.

6 Claims, 3 Drawing Figures

APPARATUS FOR HIGH SPEED WINDING OF COILS

The invention relates to an apparatus for the manufacture of coils, in which the winding wire of a fixedly arranged storage reel is guided, via a winding drum having an eccentric bore and arranged on a slide which is movable in the direction of winding, to a winding head having a retractable mandril. Coil turns on the mandril are obtained by rotation in opposite directions of the winding head and the winding drum, the mandril co-rotating with the winding head, with simultaneous movement of the slide.

With such apparatus coils can be manufactured for various applications, for example, for coils or cylinder springs, and in particular for filament coils of electric incandescent lamps, discharge lamps and discharge tubes, respectively, and the like.

In a known device of this type disclosed in German Auslegeschrift No. 1,143,930, to which U.S. Pat. No. 3,044,529 corresponds the winding drum is driven by the movable slide in such manner that during the whole winding process the drum co-rotates only a fraction of a revolution against the direction of rotation of the winding head. Upon termination of the winding process, the winding drum is moved back again over said fraction of a revolution so that the coil still present on the mandril is released. In this known device the winding speed is produced only by the winding head and is dependent on the maximum rotation speed thereof. In addition, the coils thus manufactured are unstable in themselves and therefore difficult to further process, especially in the case of comparatively long and thin coils.

It is an object of the invention to provide an apparatus with which stable coils, also having a great length, can be manufactured in a very short period of time.

According to the invention the winding drum and the winding head each have their own driving mechanism which is controllable individually and separate from the driving mechanism of the slide, and that the winding drum rotates at at least 50% of the speed of rotation of the winding head throughout the winding process. The speed of rotation of the winding drum can at most be up to 150% of that of the winding head; preferably, they both rotate at equal speeds.

Because in this case the winding drum and winding head have their own controllable driving mechanisms, the winding drum may be involved in the coil winding process. When the winding drum and the winding head are driven at the same speed in opposite directions, the coils can be wound at double the speed for a given previously determined maximum speed of the winding head, that is possible when only the winding head performs the actual winding process.

Because the winding wire comes on the winding mandril via an eccentric bore in the winding drum, a torsion is necessarily caused in the wire when the winding drum travels rapidly, which torsion increases the stability of the finished coils considerably.

In order not to transfer the torsion to the winding wire leaving the storage reel, but only to that part of the wire which is actually involved in the coil winding, according to a further feature of apparatus according to the invention, viewed in the direction of transport of the winding wire, a rear wire brake is located behind the storage reel and is secured to the movable slide and a front wire brake is located in front of the winding drum and co-rotates with the drum.

The driving mechanisms of the winding drum and the winding head preferably consist of electronically controlled servo disk-shaped-rotor winding motors having geared belt driving. Such motors can practically be adjusted in steps. The rotation transmission from the motors to the winding drum and to the winding head, respectively, may also be carried out via another slip-free driving.

The driving of the slide is advantageously carried out by a driving wedge which is provided beside the slide and is slidable at right angles to the slide and which is coupled to an electric angle measuring apparatus the signals of which serve to control the disk shaped rotor motors. The winding motors are preferably also coupled to electric angle measuring device. An electronic control device continuously senses, via the angle measuring device, the position of the motors and of the slide driving wedge and determines therefrom the signals for driving the winding motors and the motor for moving the slide driving wedge.

The apparatus according to the invention is specially suitable for the manufacture of coils having coil ends which are directed opposite with respect to each other, preferably having straight coil ends extending in the axial direction, especially co-axial ends. Such an apparatus is characterized in that during winding the coil can be wound to 10% above the previously determined number of turns, after which the coil can be wound back to the previously determined number of torns by the return of the winding drum and/or the winding head. Unstressing of the coils and an accurate alignment of the coil ends is obtained by this known method of overwinding of the coils and then winding back to the previously determined number of turns. In addition, a torsion of the winding wire between the two wire brakes and winding differences can be compensated for.

The invention will now be described in greater detail with reference to an embodiment shown in the drawing.

Figures 1, 2:
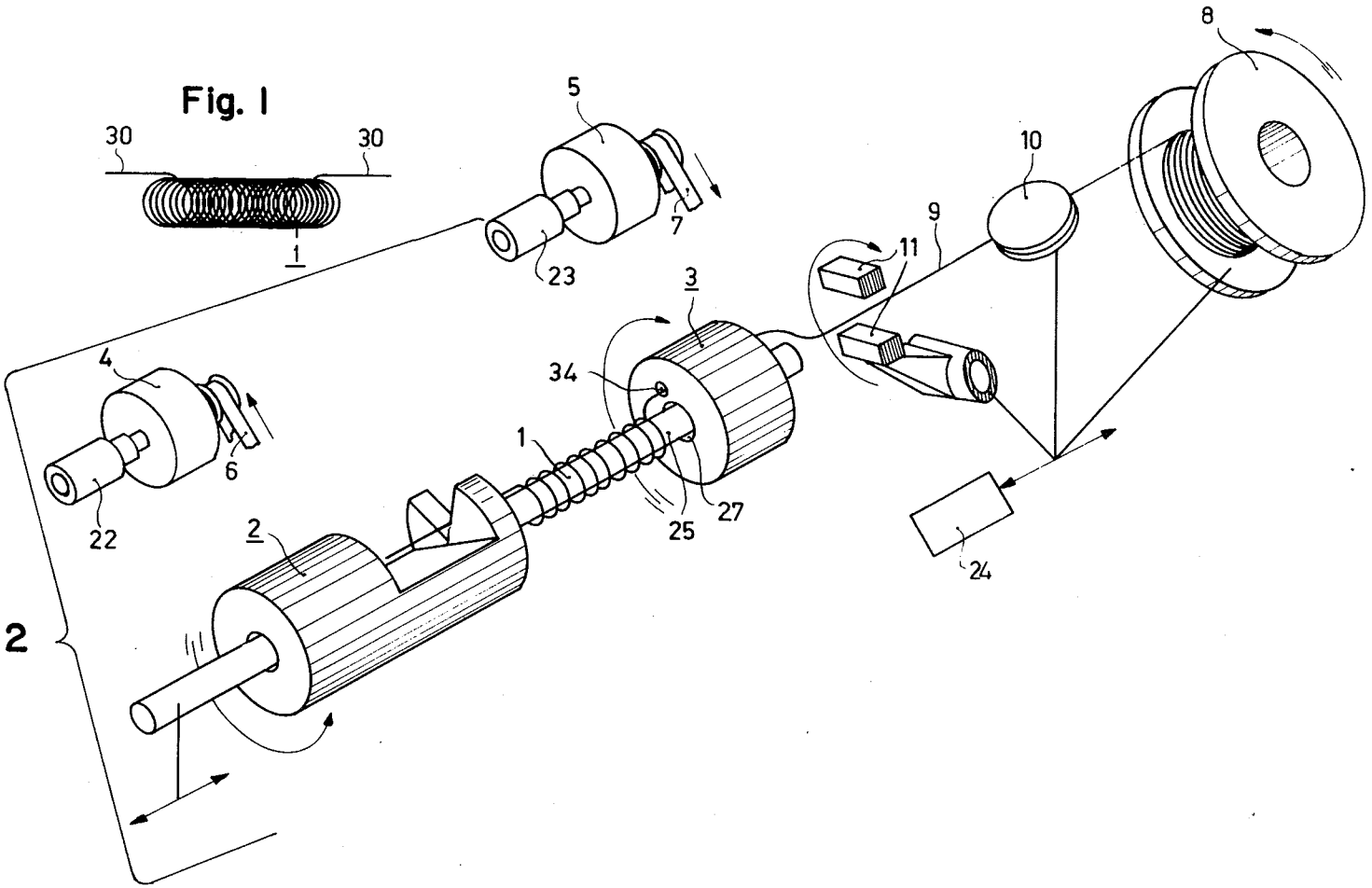
FIG. 1 is an oblique view of a coil to be manufactured.
FIG. 2 is a perspective diagrammatic view of the prominent parts of an apparatus according to the invention.

An apparatus for the manufacture of the coil 1, in particular a tungsten incandescent filament coil for incandescent lamps, mainly comprises a winding head 2 and a winding drum 3 which are each driven in opposite directions by servo disk-shaped-rotor winding motors 4 and 5, respectively, via geared belts 6 and 7, respectively. The winding wire 9 unwound from a storage reel 8 passes a rear wire brake 10 and a front wire brake 11 co-travelling with the winding drum 3, is then guided through an eccentric bore 34 through the winding drum 3 and clamped in the winding head 2 by means of tensioning tongs 32. The winding drum 3 together with the front wire brake 11, as well as the rear wire brake 10 and the storage reel 8, are secured to an axially movable slide 12 the driving of which occurs by a driving wedge 13 which is arranged beside the slide 12 and is movable at right angles to the slide and co-operates with a roller 14 arranged on the slide 12. The driving wedge 13 is driven by a motor not shown.

Figure 3:
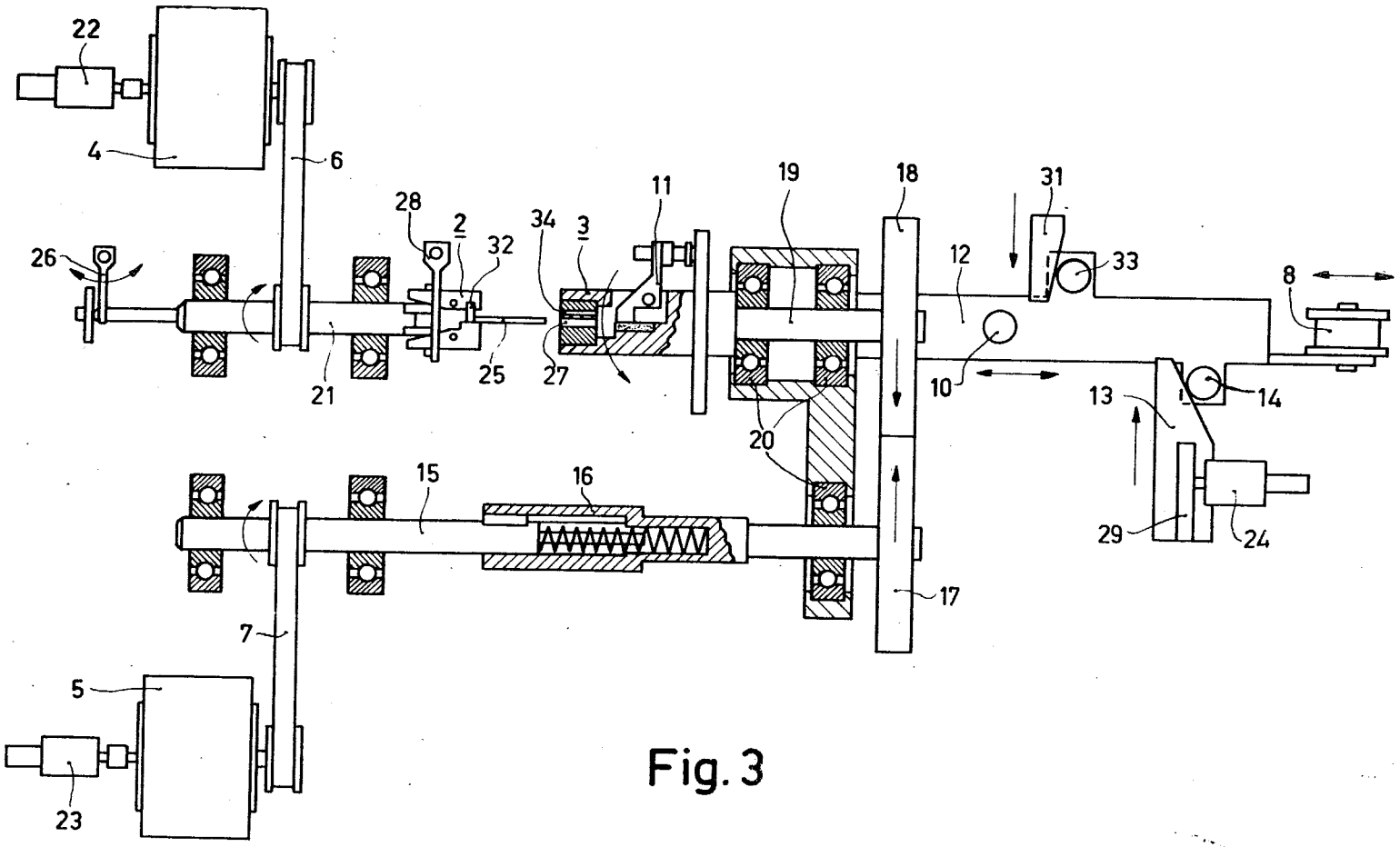
FIG. 3 is a plan view of the prominent parts of the apparatus of FIG. 2.

As is shown in FIG. 3, the winding motor 5 drives, via the geared belt 7, a shaft 15 which is connected to a toothed wheel 17 via an axially movable coupling 16. The toothed wheel 17 cooperates with a toothed wheel 18 and drives the winding drum 3 with the front wire brake 11 via a shaft 19. The shaft 19 and the coupling 16 run in bearings 20 which are also secured to the slide 12. The driving of the winding head 2 by the motor 4 occurs by the geared belt 6 and a shaft 21.

The winding motors 4 and 5 are coupled to electric angle measurement devices 22 and 23, respectively, and the slide driving wedge 13 is coupled to an angle measuring device 24 via rack and pinion drive 29. The driving mechanisms described rotate the winding drum 3 and the winding head at the same speed in opposite directions. A winding mandril 25 is guided centrally in the winding head 2 and co-rotates with the head. Via an adjusting element 26 the mandril 25 can be moved axially and be introduced in a concentric guide bore 27 of the winding drum 3.

The device described operates as follows:

The winding wire 9 is guided to the winding head 2 from winding drum 3, wire brakes 10 and 11 and storage reel 8 on the slide 12. The wire end projecting from the eccentric bore 34 is aligned in the winding head 2 by the opened tensioning tongs 32 and clamped there by a lever 28. The winding mandril 25 is inserted in the guide bore 27 of the winding drum 3 by the adjusting element 26. The winding head 2 is driven in a left rotation by the motor 4 and the winding drum 3 with the front wire brake 11 is driven in a right rotation by the motor 5. The slide driving wedge 13 is simultaneously moved forward so that the slide 12 travels to the right and hence provides room for the successive turns of the coil to be wound.

The movement of the driving wedge 13 is transferred to the angle measuring device 24. Said angle measuring device 24 as well as the angle measuring devices 22 and 23 coupled to the motors 4 and 5 are connected to an electronic control which, via the angle measuring devices, receives electrical signals related to the positions of the driving wedge 13 and of the motors 3 and 5, respectively, and derives therefrom the correct driving signals for the winding motors 4 and 5 and for the driving motor of the wedge 13. As a result of this, the winding operation occurs synchronously with the motors 4 and 5, while the slide 12 moves horizontally in agreement with the winding pitch of the winding head 2.

The control device is adjusted so that the coil to be wound can be wound up to 10% above the previously determined number of turns. By the subsequent return of the winding drum 3 and/or the winding head 2, the coil is wound back to the previously determined number of turns and therewith unstressed, so that the coil ends 30 (FIG. 1) extending in the axial direction become located co-axially relative to each other. After completion of the actual winding process, the drawing of the ends 30 of the coil 1 takes place by means of an adjustment wedge 31 which is provided beside the slide 12 and can be moved at right angles thereto and which moves the slide horizontally to the right via a roller 33. By means of a tool not shown the coil is then cut in the center of the drawn end portion. The winding mandril 25 is then retracted by the adjusting element 26 and the tensioning tongs 32 in the winding head 2 are opened by means of the lever 28 so that the coil 1 can be removed.

Because, as already described, the winding wire 9 is twisted during winding, the device according to the invention enables the processing of wires having considerably larger diameters than has been the case so far. In a practical embodiment a tungsten winding wire having a diameter of 100$\mu$ has been wound on a winding mandril having a diameter of 400$\mu$ to form a coil having 37 turns of which one was subsequently wound back. 3000 such coils per hour have been manufactured with a device according to the invention.

What is claimed is:

1. An apparatus for winding coils in which wire is guided by a winding drum having an eccentric axially extending bore movable in the direction of winding about a retractable mandril to a winding head, comprising a winding head having an axis, a slide mounted for relative movement with respect to said winding head in a direction parallel to said axis, a winding drum mounted on said slide coaxially with said winding head for rotation about said axis, said drum having an eccentric axially extending bore, means for supplying wire to be wound to and through said bore, at least a part of said supplying means being adjacent said drum means on said winding head for clamping a wire end thereto, a mandril mounted coaxially in said winding head, means connected to said mandril for moving said mandril axially with respect to said winding head, and means connected to said winding head and said drum for rotating said winding head and said drum about said axis in opposite directions, said winding head being rotated at a speed between approximately 50% and 150% of the speed of the drum.

2. An apparatus as claimed in claim 1 wherein said mandril is mounted for co-rotation with the winding head.

3. An apparatus as claimed in claim 2 wherein said means for rotating comprises means for driving said winding head and said drum at equal speeds in said opposite directions.

4. An apparatus as claimed in claim 2, wherein said supplying means comprises a wire storage reel, a rear wire brake mounted so as to be fixed in position with respect to said slide, and a front wire brake mounted on said slide for co-rotation with said winding drum, wire to be wound being guided from said reel in succession to said rear wire brake, said front wire brake, and said winding drum.

5. An apparatus as claimed in claim 2 comprising means connected to said slide for displacing said slide axially, and wherein said rotating means comprises independent, individually controlled driving mechanisms for said winding head and said drum respectively.

6. An apparatus as claimed in claim 5, wherein said displacing means comprises a first electric angle measuring device, and said respective independent driving mechanisms each comprises a servo motor coupled to an electric angle measuring device coupled to said first electric angle measuring device.

* * * * *